United States Patent [19]

Brent

[11] 4,207,552

[45] Jun. 10, 1980

[54] ELECTRIC HEATING ELEMENTS

[75] Inventor: Richard W. Brent, Pittsburgh, Pa.

[73] Assignee: Emerson Electric Co., St. Louis, Mo.

[21] Appl. No.: 964,956

[22] Filed: Nov. 30, 1978

[51] Int. Cl.[2] ..... H01C 1/14

[52] U.S. Cl. ..... 338/322; 174/77 R

[58] Field of Search ..... 338/273, 274, 322, 323, 338/329; 219/541; 174/76, 77 R; 29/610, 611

[56] References Cited

U.S. PATENT DOCUMENTS

| | | | |
|---|---|---|---|
| 1,237,401 | 8/1917 | Sprong et al. | 174/76 X |
| 2,043,196 | 6/1936 | Finlayson | 174/77 R |
| 2,177,509 | 10/1939 | Abbott | 174/84 F |
| 2,269,194 | 1/1942 | Finlayson | 174/77 |
| 2,352,159 | 6/1944 | Brodie | 174/77 |
| 2,807,696 | 9/1957 | Boggs et al. | 174/77 R X |
| 2,860,226 | 11/1958 | Williams | 219/541 X |
| 3,040,284 | 6/1962 | Connell | 338/273 X |
| 3,087,134 | 4/1963 | McOrlly | 338/273 |

*Primary Examiner*—C. L. Albritton
*Attorney, Agent, or Firm*—Michael Williams

[57] ABSTRACT

An electric heating element having an improved electrical termination. The heating element comprises a conventional tubular metal sheath with a heating coil embedded in granular refractory material which is contained within the sheath. Terminal pins are electrically connected to opposite ends of the heating coil and extend outwardly of opposite ends of the sheath. My improvement provides for easy and efficient connection of a power conductor to a terminal pin and includes a metal sleeve having interengagement with a respective sheath end to provide protection for the terminal connection.

10 Claims, 4 Drawing Figures

ELECTRIC HEATING ELEMENTS

BACKGROUND AND SUMMARY

Metal sleeves connected to respective ends of a tubular metal sheath of an electric heating element are known in the prior art, but insofar as I am aware, the type of termination herein disclosed is new and novel in that a power conductor may be easily and efficiently connected to a terminal pin while the metal sleeve is not connected to the sheath, and after the terminal connection is made the sleeve is moved to telescopic fit with a sheath end to surround and protect the terminal connection. The sleeve is thereafter filled with a cement to seal the same.

DESCRIPTION OF THE DRAWING

In the drawing accompanying this specification and forming a part of this application, there are shown, for purpose of illustration, embodiments which my invention may assume, and in this drawing.

DESCRIPTION OF THE PREFERRED EMBODIMENT

Figure 1:
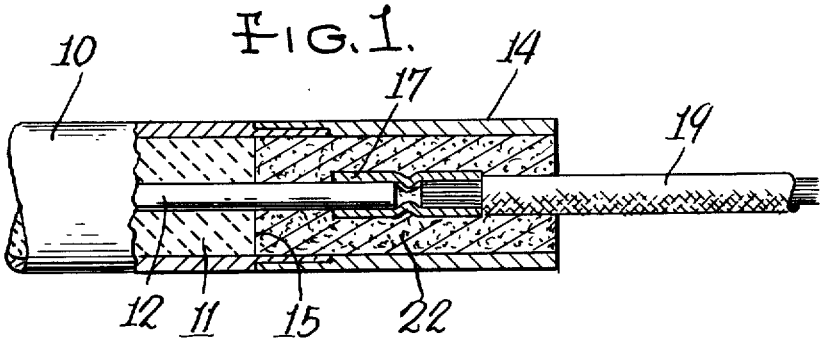
FIG. 1 is an enlarged, fragmentary sectional view of the terminal portion of an electric heating element, showing one embodiment of my invention.

The conventional tubular heating element comprises a tubular metal sheath 10 filled with compacted granular refractory material 11. A heating resistor (not shown) is embedded within the refractory material and terminal pins 12 (only one shown in the drawing) are electrically connected to opposite ends of the resistor. The foregoing is standard construction with which my invention is associated.

Through use of my invention, power conductors may be easily and efficiently connected to respective terminal pins and thereafter a metal sleeve 14 is telescopically fitted with a respective end of the sheath to protect the terminal connection.

The sheathed electrical heater may be produced in conventional manner wherein a heating coil and connected terminal pins are embedded within refractory material, and the heater subjected to a rolling or side-pressing operation to reduce the diameter of the sheath and thereby highly compact the refractory material. Rolling or side-pressing usually causes work hardening of the metal sheath and therefore the rolled sheath is subjected to an annealing operation.

After annealing (if annealing is required) some of the refractory material is removed from each end of the sheath to form an end pocket 15. In the embodiments herein disclosed, each sheath end is machined to provide a reduced-diameter end portion 16. The terminal pins 12 are then cropped to extend a predetermined distance outwardly of an open end of the sheath. In the disclosed embodiments it has been found preferable to crop the terminal pins so that they extend one-quarter inch (6.3500 millimeters) beyond the sheath end.

Thereafter, a tubular, metal terminal connector 17, of conventional form, is crimped to the terminal pin 12 and to the bare end 18 of an insulated conductor 19, the latter being adapted for connection to a source of electrical energy. As seen in FIG. 1, the connector has a central inwardly formed portion 17.1 to form an annular interior shoulder against which the ends of the terminal pin and power conductor abut to insure sufficient penetration of each into the connector. The connector is then crimped in the areas indicated by the dotted lines 20 in FIG. 2. It has been found preferable to heli-arc weld the connector 17 to the ends of the terminal pin and power conductor, after the crimping operation, although this is not always necessary.

It will thus be appreciated that a terminal conductor 19 may be easily and efficiently connected to a terminal pin end since the parts are exposed for this operation. During this time, the metal sleeve 14 may be in the withdrawn position shown in FIG. 2. In the preferred embodiment, the exterior diameter of the sleeve 14 is substantially equal to the exterior diameter of the sheath so that when assembled it forms a smooth continuation of the latter. The internal diameter of the sleeve may be equal to the interior diameter of the sheath, as shown.

Figure 2:
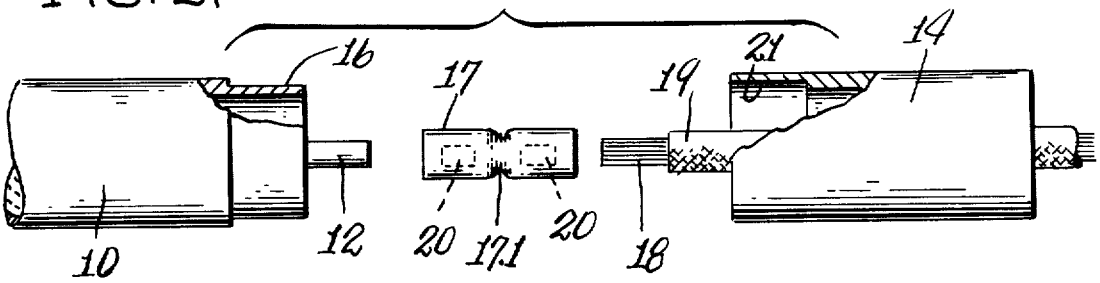
FIG. 2 is a separated view of the elements shown in FIG. 1, the elements being shown in elevation with parts thereof broken away.

As best seen in FIG. 2, an end of the sleeve 14 is internally machined at 21 to provide a larger internal diameter for a force fit with the portion 16 of the sheath. Therefore, after the connectors 17 are connected to the ends of the terminal pins and power conductors, the sheath is placed in a press and the sleeves 14 are pressed to telescoping fit with respective sheath ends, as shown in FIG. 1.

Thereafter, a cement 22 is poured into the cavity defined by the interior of the sleeve and to fill it and the pocket 15, at the sheath end. If the heating element is to be subjected to relatively high operating temperatures, a refractory, air-set cement may be used. Such cement is usually a ceramic powder mixed with water, and perhaps other ingredients, and will withstand operating temperatures of about 800 degrees Fahrenheit (about 417 degrees Centigrade). For lower temperatures, and to produce a hermetic seal, an epoxy or RTV cement may be used.

It will be appreciated, from the foregoing, that the disclosed method not only enables the terminal pins to be connected to the power conductors with ease, but also that the sleeve protects the terminal connection from wear, abuse and (where a hermetic-seal cement is used) from deleterious fluids. Further, the cement encapsulates the connector 17 and its connectors, and when set or cured, provides a strain relief for the flexible power conductor 19.

DESCRIPTION OF OTHER EMBODIMENT

Figure 3:
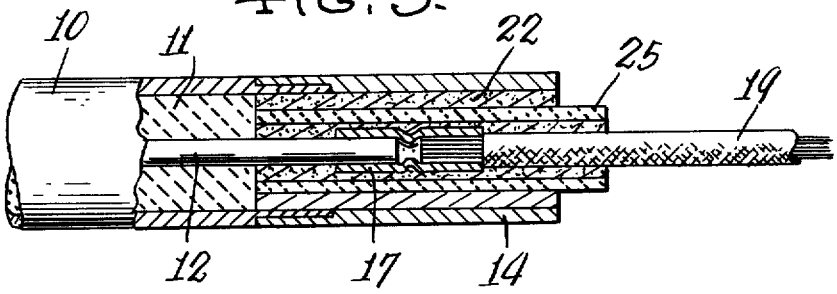
FIG. 3 is a view similar to FIG. 1, but showing a slightly different embodiment of my invention.
Figure 4:
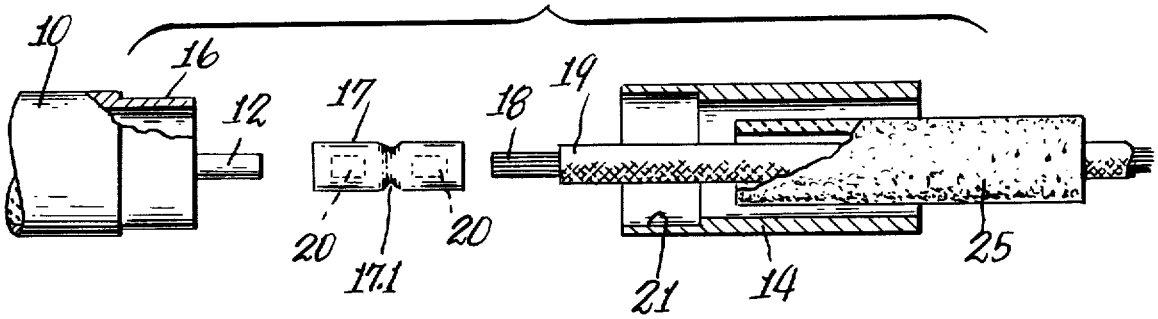
FIG. 4 is a separated view of the elements shown in FIG. 3.

The embodiment disclosed in FIGS. 3 and 4 is very similar to that heretofore described, and like parts will be designated by like reference numbers. The distinction in this embodiment is the addition of a ceramic sleeve 25, which loosely fits about the connector 17 and is pressed into the cement 22 before the latter is set or cured until the ceramic sleeve abuts against the bottom of the pocket 15, as seen in FIG. 3. The ceramic sleeve preferably is of a length so that it has an outer portion extending outwardly of the metal sleeve 14. The cement not only fills the space between the exterior surface of the ceramic sleeve and the interior surface of the sleeve and sheath, but as the ceramic sleeve 25 is pressed into the cement, the latter is extruded through the interior of the ceramic sleeve to completely fill its interior and encapsulate the connector 17 and the adjoining parts of the terminal pin and current conductor.

I claim:

1. A termination for an electric heating element having a metal sheath, a heating resistor within said sheath, a terminal pin electrically connected to an end of said resistor at a location within said sheath and having an end portion extending outwardly of an end of said sheath, heat-conducting material within said sheath and electrically insulating said terminal pin from said sheath, the improvement comprising:

a tubular metal connector having an inner end receiving the outwardly-extending end portion of said terminal pin and an outer end receiving the bare end of an insulated power conductor, said connector being freely accessible so that its ends are exposed for easy electrical connection to said pin end portion and said bare end, a rigid sleeve surrounding said power conductor in a standby position to permit electrical connection of said connector and said pin end portion and said bare end, and subsequently moved axially along said power conductor to surround said connector and adjoining parts of said pin end portion and said power conductor in a manner to provide an annular space therebetween, an inner end of said sleeve being connected to said sheath end in a manner as to provide an extension of said sheath which is not materially different in transverse size, and cement poured into said annular space and permitted to harden to encapsulate said connector and said adjoining parts and to provide a strain relief for that part of the insulated power conductor which extends outwardly of said sleeve.

2. The construction according to claim 1 wherein said connector ends are crimped to said terminal pin portion and said bare end.

3. The construction according to claim 2 wherein said connector ends are welded to said pin portion and said bare end after the crimping operation.

4. The construction according to claim 1 wherein said sleeve is metal and has a telescopic fit with said sheath end.

5. The construction according to claim 1 wherein the outer diameter of said sleeve is substantially equal to the outer diameter of said sheath to form a relatively smooth continuation thereof.

6. The construction according to claim 1 wherein said sheath has a reduced-diameter portion at its said end, and wherein said sleeve is metal and has an enlarged internal diameter at its inner end to telescopically receive said sheath end with a force fit.

7. The construction according to claim 1 wherein a ceramic sleeve freely fits over said connector and said adjoining parts with the outer surface of said ceramic sleeve providing said annular space with the interior of said metal sleeve, said cement filling said annular space and the space between the interior of said ceramic sleeve and said connector and said adjoining parts.

8. The method of providing protection for the termination of an electric heating element, said element having a metal sheath, a heating resistor within said sheath, a terminal pin electrically connected to an end of said resistor at a location within said sheath and having an end portion extending outwardly of an end of said sheath, heat-conducting material within said sheath and electrically insulating said resistor and terminal pin from said sheath, said method comprising, fitting an inner end of a tubular metal connector over said pin end portion and the bare end of a power conductor into an outer end of said connector, and electrically joining the latter to said pin end portion and said bare end, thereafter slipping a rigid sleeve over said power conductor to position wherein an inner end of said sleeve engages said sheath end, and directly connecting said sleeve to said sheath to form an extension of the latter and to surround said tubular connector and adjoining parts of said pin portion and said power conductor with an annular space therebetween, and thereafter filling said annular space with a flowable and subsequently hardenable cement to encapsulate said tubular connector and said adjoining parts and to provide a strain relief for that part of the power conductor which extends from said rigid sleeve.

9. The method according to claim 8 wherein said sleeve is formed of metal and its inner end and said sheath end are connected in axially slidable telescopic manner.

10. The method according to claim 9 wherein a ceramic sleeve is slid over said power conductor and into said annular space after said metal sleeve has been connected to said sheath end and after said cement, in fluid form, has been introduced into said annular space, said ceramic sleeve being disposed around said tubular connector and said adjoining parts and extruding said cement to fill the space between its interior and said connector and said adjoining parts.

* * * * *